United States Patent [19]

Ciaffone

[11] 4,395,822

[45] Aug. 2, 1983

[54] TWIN BLADE CARTRIDGE WITH PURGING FIN AND COOPERATING SLIDABLE COVER CAP

[75] Inventor: John T. Ciaffone, Bridgeport, Conn.

[73] Assignee: Warner-Lambert Company, Morris Plains, N.J.

[21] Appl. No.: 308,765

[22] Filed: Oct. 5, 1981

[51] Int. Cl.[3] ..... B26B 21/22

[52] U.S. Cl. ..... 30/41; 30/79

[58] Field of Search ..... 30/41, 41.5, 59, 60, 30/61, 79, 77

[56] References Cited

U.S. PATENT DOCUMENTS 4,047,296 9/1977 Ishida ..... 30/41

4,257,160 3/1981 Murai ..... 30/41

4,265,015 5/1981 Asano ..... 30/41

4,300,285 11/1981 Endo ..... 30/41

4,344,227 8/1982 Chen ..... 30/41

FOREIGN PATENT DOCUMENTS 52-22791 2/1977 Japan ..... 30/41

*Primary Examiner*—Jimmy C. Peters

*Attorney, Agent, or Firm*—R. S. Strickler

[57] ABSTRACT

A wet shaving cartridge having at least two blades, a movable fin between blades for purging shaving debris and a slidable, permanently connected protective blade cover with a driving connection between the cover and the fin such that motion of the cover moves the fin.

7 Claims, 12 Drawing Figures

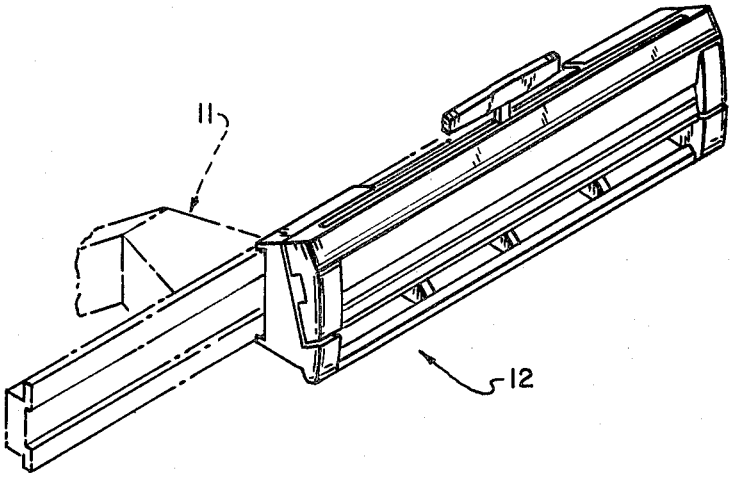
FIG.1
PRIOR ART
FIG.2
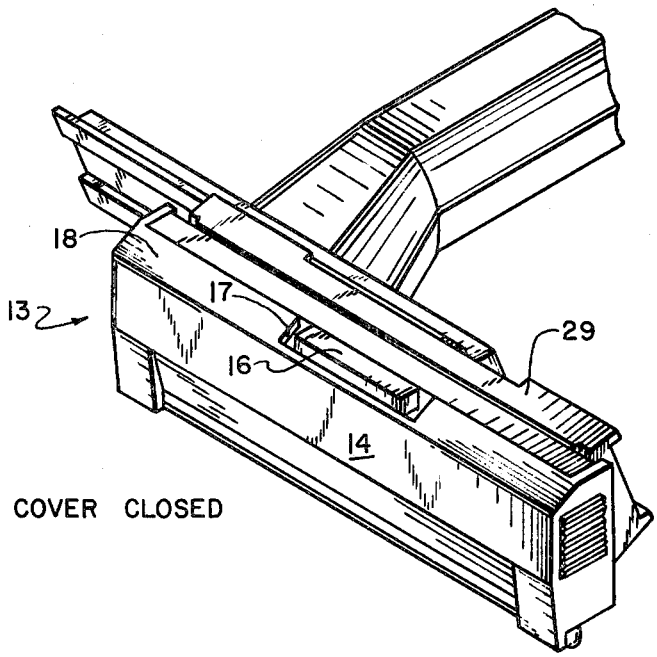

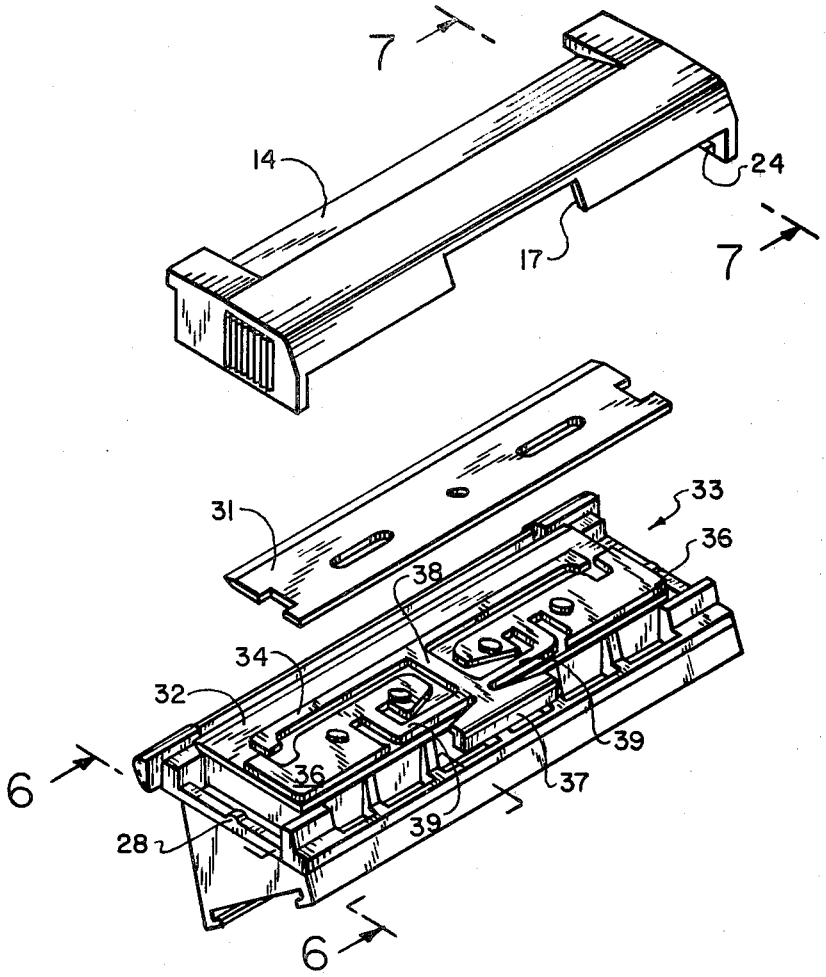
FIG.5
FIG.6
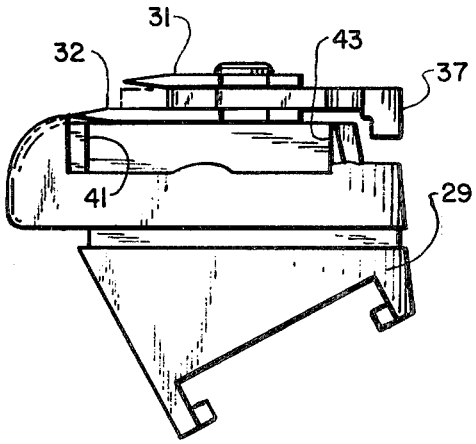
FIG.7
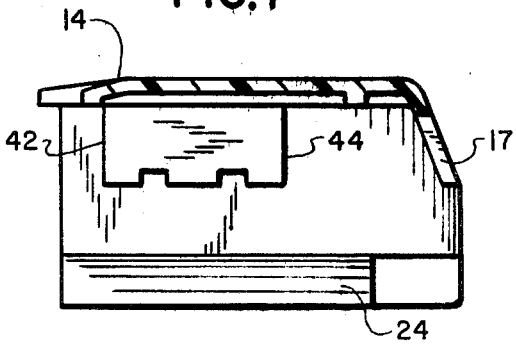

FIG.8
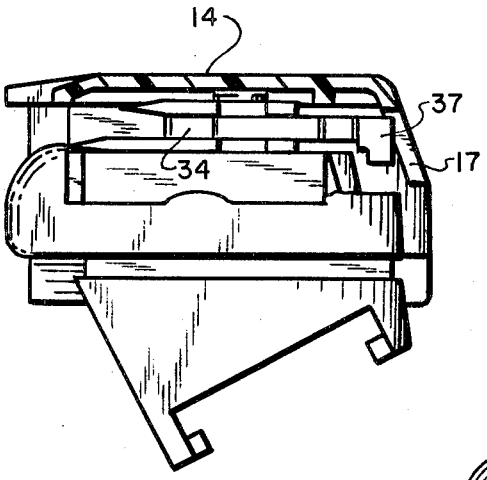
FIG.9
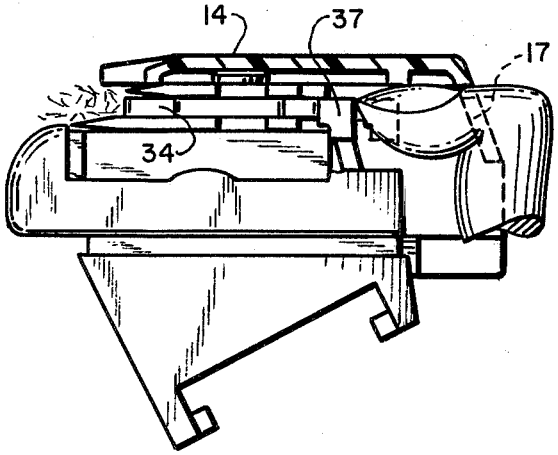
FIG.10
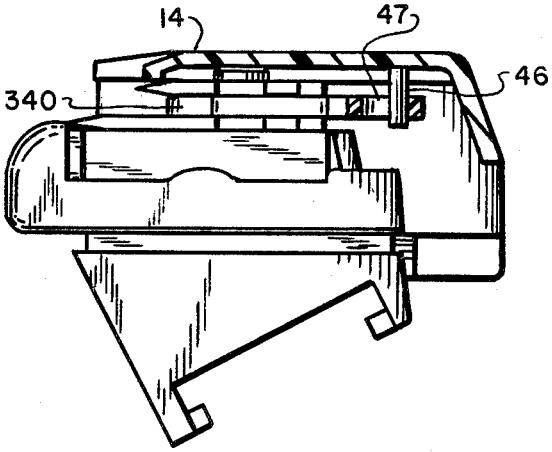
FIG.11
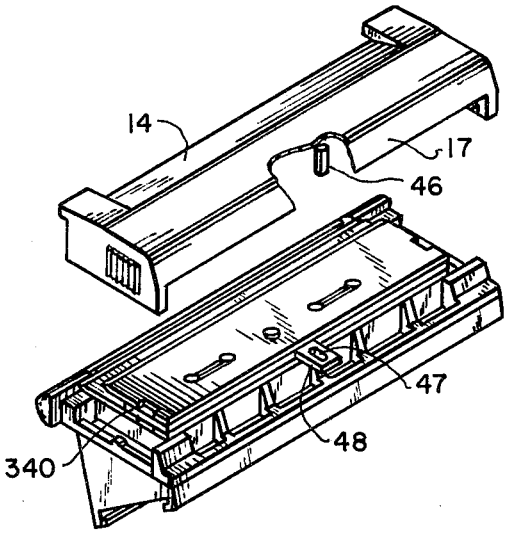
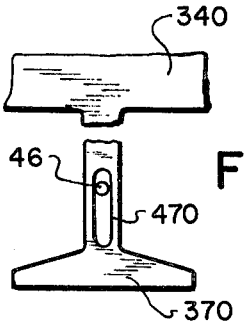
FIG.11A

TWIN BLADE CARTRIDGE WITH PURGING FIN AND COOPERATING SLIDABLE COVER CAP

BACKGROUND OF THE INVENTION

The present invention relates to wet shaving and in particular to razors used during the course of such shaving.

Representative prior art razors are disclosed and claimed in a pending U.S. patent application Ser. No. 180,756 filed Aug. 25, 1980, now U.S. Pat. No. 4,344,227 by Chen et al entitled IMPROVED CLEAN-OUT MECHANISM FOR TWIN BLADE SHAVING UNIT and in a pending U.S. patent application Ser. No. 108,747 filed Dec. 31, 1979, by Bowman et al entitled RAZOR BLADE ASSEMBLY WITH MOVABLE COVER CAP.

The '747 case is directed to a low cost disposable wet razor having a blade cover or cap which, although permanently attached to the razor, is slidable to and fro to cover and uncover the blade edges.

The '756 case is directed to a "clean-out" blade or fin combined with a blade spacer where the clean-out blade is movable between fixed razor blades to purge the razor blades of shaving debris.

A particular feature of the present invention is the provision of a novel mechanical combination between a blade cover and a clean-out fin.

A special feature of the invention is the provision of a driving connection between the cover and the clean-out fin such that when the cover is moved in a predetermined direction the clean-out blade is also moved.

A still further feature of the invention is the provision of a "lost motion" connection between the cover and the clean-out fin facilitating motion of the clean-out fin independently of motion of the cover.

SUMMARY OF THE INVENTION

A wet shaving device embracing basic principles of the present invention may comprise: a blade cartridge having at least two spaced blades each having a cutting edge, a movable member or fin sandwiched between the blades for purging the blades of shaving debris, a cover connected permanently to the blade cartridge and movable to and fro relative to the cartridge and means making a driving connection between the cover and the movable member operative to drive the member whenever the cap is moved in a predetermined direction.

It is within the scope of the present invention to arrange the sliding cover relative to the clean-out fin such that the clean-out fin is operable manually with or without a mechanical connection to the cover. For example, the invention contemplates independent manual operation of the clean-out fin when there is a mechanical connection to the cover as well as when no connection between these two movable members exists.

Other features and advantages of the present invention will become apparent from an examination of the succeeding specification when read in conjunction with the appended drawings, in which:

BRIEF DESCRIPTION OF THE DRAWINGS

FIG. 1 is a perspective view of a prior art blade cartridge with a purging fin and a fixed immobile cover or cap;

FIG. 2 is a view similar to FIG. 1 showing a blade cartridge with a debris-purging fin in combination with a movable cover or cap with the cover in the closed position;

FIG. 5 is an exploded view of FIG. 4 showing the purging fin at rest;

FIG. 6 is an end elevation of a portion of FIG. 5 as viewed in the plane represented by the numerals 6—6;

FIG. 7 is a view of the interior of the skirt or side wall of the cap of FIG. 5;

FIGS. 8 and 9 show an operating tab on the purging fin and a tab access opening in the cover;

FIGS. 10 and 11 show a preferred embodiment of the invention illustrating the driving connection between the movable blade cover and the clean-out fin; and FIG. 11A shows a modified link in the clean-out fin.

DESCRIPTION OF SPECIFIC EMBODIMENTS

Figure 3:
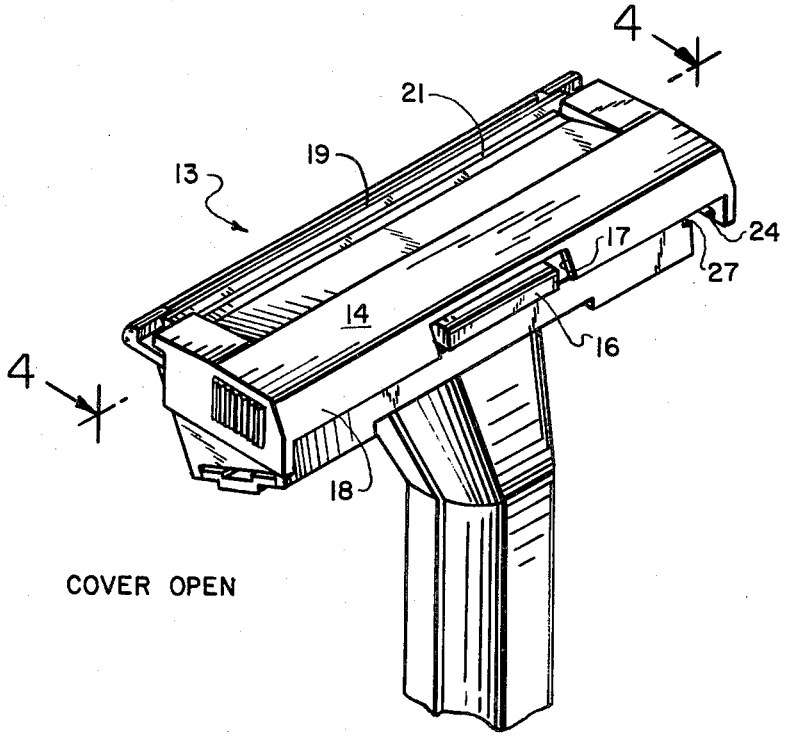
FIG. 3 shows one embodiment of the cartridge with cover or cap in the open position with the blade edges properly exposed for shaving and the purging fin in the normal, retracted or "at rest" position.

Referring now in detail to the drawings, in particular FIGS. 1 through 7, the reference numeral 11 designates a conventional razor handle making a separable connection with a prior art blade cartridge 12 in well known fashion.

FIGS. 2 and 3 show a blade cartridge 13 having a sliding, permanently attached cover 14 with a clean-out fin operating tab 16 received within and depressible through access opening 17 formed in the rear wall 18 of the cover 14.

FIG. 2 shows the cover 14 in the closed position with the clean-out fin in its retracted or normal position while FIG. 3 shows the blade cover 14 in the open position with blade edges 19 and 21 properly exposed for wet shaving. The clean-out fin is in the normal, retracted position and, as will be more apparent hereinafter, in this embodiment of the invention there is no mechanical connection between the cover and the clean-out fin.

Figure 4:
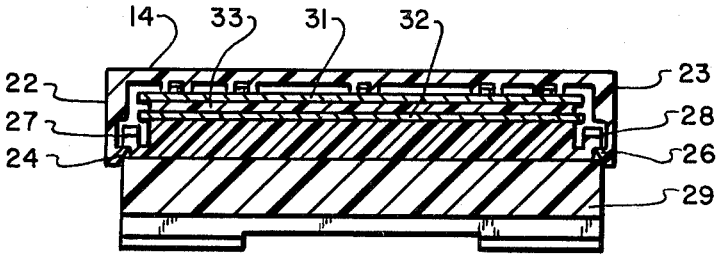
FIG. 4 is a sectional view of FIG. 3 in the plane indicated by the arrows 4—4 in FIG. 3.

FIG. 4 shows the cap 14 having side walls 22 and 23 terminating in inwardly projecting lips 24 and 26 (defining a slide) mating and cooperating with shoulders 27 and 28 (defining guide means) to facilitate a sliding but permanent connection between the cover 14 and a blade support 29 as disclosed and described with greater particularity in said copending '747 application.

The blade means includes an upper blade 31 and a lower blade 32 straddling a combined spacer/clean-out member 33.

As is more apparent in FIG. 5, and as further described in said copending '756 application, the member 33 includes a movable purging or clean-out fin 34 formed or molded integrally with a fixed blade spacer 36.

The spacer 36 is staked to the blade support 29 in well known fashion while the clean-out fin 34 is movable from its normal or retracted position of FIG. 5 upon depression of tab 37.

The resilient arms 38 and 39 deflect as the tab 37 is depressed and the natural tendency of the arms to return to the rest position automatically retracts the clean-out fin 34 upon release of tab 37.

As is most apparent in FIGS. 6 and 7, and in all embodiments of the invention, the stroke of the cover 14 relative to the blade package or blade cartridge is controlled by stop means defining cooperating stop elements 41 and 42 upon closing and stop elements 43 and 44 upon opening or exposing the blade means for shaving.

FIGS. 8 and 9 show an embodiment in which there is no connection between the cover 14 and the clean-out fin 34.

In this arrangement, access opening 17 permits digital depression of tab 37 to purge blade means of debris in any position of the cover 14. As stated previously, the tab 37 and thus the clean-out fin 34 retract automatically in response to spring action.

FIGS. 10 and 11 show the preferred embodiment in which there is a mechanical connection between the cover 14 and the clean-out fin 340. A pin 46 depending from cover 14 engages a slot or link 47 formed in a neck 48 of clean-out fin 340. In this arrangement, the clean-out fin 340 is driven to and fro each time the cover is opened and closed.

Alternatively, the link can be elongated as shown at 470, FIG. 11A, to permit operation of the clean-out fin 340 independently of motion of the cover 14.

Obviously an access opening such as shown in FIG. 9 must be provided in the rear wall 17 of the cover and the clean-out fin provided with an operating tab 370.

In this alternative arrangement, motion of the cover to a closed position drives the clean-out tab 340 while upon return of the cover to the open or shaving position the clean-out fin returns automatically in response to spring power.

Note further that in the FIG. 11A arrangement the clean-out fin 340 can be operated digitally independently of the position of the cover 14 by virtue of the elongated link 470 and spring power.

What is claimed is:

1. A razor blade cartridge having at least two spaced blades having cutting edges, a movable member or fin sandwiched between the blades for purging the blades of shaving debris, a cap connected permanently to the blade cartridge and movable to and fro relative to the cartridge and means making a driving connection between the cap and said movable member operative to drive said movable member whenever the cap is moved in a predetermined direction.

2. The device of claim 1 in which the means making the driving connection define a pin and a cooperating link.

3. The device of claim 2 in which the pin projects from the cap and engages an elongated link formed in the movable member.

4. The device of claim 3 in which the link is fashioned with sufficient elongation to permit motion of said movable member independently of the motion of said cap.

5. The device of claim 4 in which said movable member is molded integrally with a fixed spacer.

6. The device of claim 5 in which the movable member is formed with a tab for digital operation.

7. A razor blade cartridge having at least two spaced blades having cutting edges, a movable member or fin sandwiched between the blades for purging the blades of shaving debris, said fin having an operating tab, a cap connected permanently to the blade cartridge and movable to and fro relative to the cartridge, said cap having an opening facilitating access to said operating tab whereby said fin is movable independently of said cover.

* * * * *